United States Patent [19]

Elder

[11] 4,066,228

[45] Jan. 3, 1978

[54] ROUTE CONTROL SYSTEM FOR RAILROAD INTERLOCKINGS

[75] Inventor: J. Calvin Elder, Penn Hills, Pa.

[73] Assignee: Westinghouse Air Brake Company, Swissvale, Pa.

[21] Appl. No.: 730,342

[22] Filed: Oct. 7, 1976

[51] Int. Cl.[2] ..... B61L 27/00

[52] U.S. Cl. ..... 246/5; 104/88; 246/134

[58] Field of Search ..... 246/3, 4, 5, 131, 132, 246/133, 134; 104/88; 235/150.24

[56] References Cited

U.S. PATENT DOCUMENTS

| | | | |
|---|---|---|---|
| 3,219,815 | 11/1965 | Livingston | 246/5 |
| 3,937,428 | 2/1976 | Elder | 246/134 |

*Primary Examiner*—Trygve M. Blix
*Assistant Examiner*—Reinhard J. Eisenzopf
*Attorney, Agent, or Firm*—A. G. Williamson, Jr.; R. W. McIntire, Jr.

[57] ABSTRACT

A route oriented interlocking control system with only entrance, exit, and alternate route selectors on the control machine console. No track switch controllers or indications are provided at the control location. Operation of entrance and exit selectors in sequence establishes desired route storage within the control machine, after the absence of any conflicting route and the non-occupancy of involved track sections are checked. This route control is then transmitted to the field location to select the field route relay, position the track switches, and clear the proper wayside movement indicator to authorize train movement through the route when all switches are positioned and the track within the interlocking is unoccupied. Indications of the registry of the route control and operation of the movement indicator are returned to the office display console. Route release occurs by secondary circuit controllers when the train occupies the final track section. This sectional release allows the selection and storage of route information for any route not conflicting with the initial portion of the released route when cleared by the train. Selection of an alternate or run-around route is made by operation of single device designating that alternate route prior to the operation of the entrance and exit devices for the basic route. Improper operation of the control machine results in the cancellation by primary and secondary circuit controllers of all route information storage and no route is aligned.

11 Claims, 8 Drawing Figures

| FIG. 1A | FIG. 1B |
|---|---|
| | FIG. 1C |

4PB
8PB
10PB
4MIEK
8MIEK
10MIEK
2-4APB
2MIEK
6MIEK
2PB
6PB
4PBS
2-4R
6-4R
3TP
7TP
4XS
5TP
2-4 APBS
7-9TP
9TP
2XS
6XS
2PBS
6PBS
TO FIG. 2
FROM FIG. 3A

FUNCTION CONVERSION & TRANSMISSION APPARATUS
OFFICE TO FIELD
2-4RF
2-4ARF
2-8RF
2-10RF
6-4RF
6-8RF
6-10RF
2M
4M
6M
8M
10M
(TO FIG.1A)
(TO FIG.1B) 18
4XS 2-4X
2XS 2X-4
19(TO FIG.1B)
4XS 6-4X
6XS 6X-4
23(TO FIG.1C)
10XS 6-10X
6XS 6X-10
22(TO FIG.1C)
10XS 2-10X
2XS 2X-10
20(TO FIG.1C)
8XS 2-8X
2XS 2X-8
21(TO FIG.1C)
8XS 6-8X
6XS 6X-8
2-4A
2-4R
6-4R
6-10R
2-10R
2-8R
6-8R
5TP
2PBS
6PBS
3TP
4PBS
7-9TP
10PBS
8PBS
2-4APBS

ROUTE CONTROL SYSTEM FOR RAILROAD INTERLOCKINGS

BACKGROUND OF THE INVENTION

My invention relates to a route control system for railroad interlockings. More specifically, the invention pertains to a route oriented interlocking control system with no switch indication or control function at the control office and which prevents the establishment of an undesired route after an inadvertent improper control console operation.

Many railroad terminal installations, e.g., combinations of receiving, departure, and classification yards and service facilities, have one or more interlocking locations to route trains into the proper track for handling. These are distinct and separate from any switching matrix for the classification yard. Since speed of train movement is restricted, e.g., slow, through such track layouts, non-vital movement indicators can be used to authorize a train to proceed but vital switch detector locking is still required in the field. Thus a simpler or more direct interlocking control is possible and desirable. A route type control system is also desirable, since it is more efficient to select and set up the entire route by the operation of one or two control devices to quickly align routes for successive movements. This also relieves the operator of the control of individual switches and signals. The sectional release of an established route as a train traverses the layout allows the earlier selection and alignment of the next required route which may conflict only in certain portions. One requirement is then to allow the operator to make route selections easily and to automatically release an established route quickly when its use is finished to enable the selection of another route. Another problem is to avoid aligning incorrect routes due to an inadvertent operation of the control devices. For example, an operator may improperly actuate two entrance devices prior to actuating a selected exit control device, or may inadvertently actuate two exit devices simultaneously. If such action occurs, the system should automatically reset and thus inhibit the establishment of an undesired route. Such features are also applicable, at least to a considerable degree, to the control of main line interlockings.

Accordingly, an object of my invention is an improved route control system for railroad interlockings.

Another object of the invention is a railroad route interlocking control system in which the control location requires no switch machine control or indication elements.

A further object is an interlocking control system which is route oriented and allows sectional release of established routes.

Yet another object is a railroad interlocking control system which is route oriented, with all switch controls and indications located only at the wayside stations.

A still further object of my invention is a route control system for a railroad interlocking with non-vital movement indicators, route locking, sectional release, and with all switch control and indication devices only at the wayside with vital detector locking.

Yet another object of the invention is a route type interlocking control system, with route selection, by sequential operation of entrance and exit end push buttons, stored in stick relays, with a communication link between control office and field locations to transmit stored route selection to the field, where all switch apparatus and locking is located, and route selection, movement indicator, and track occupancy indications from field to office.

An object is a route oriented interlocking control system with push botton selection and/or control of run around or alternate routing with individual switch control levers.

Still another object of my invention is a route oriented control system for railroad interlockings with automatic cancellation of stored route information if improper control machine operation occurs.

Also an object of the invention is a control system for a railroad interlocking layout with automatic cancellation of route exit and entrance storages if more than one entrance or exit location is inadvertently selected at the same time during control machine operation, so that an undesired route is not established.

Other objects, features, and advantages of my invention will become apparent from the following specification when taken with the accompanying drawings and appended claims.

SUMMARY OF THE INVENTION

In the practice of the invention, control devices, shown as push-pull buttons, are mounted at appropriate locations in a track diagram of the interlocking layout on a control console at the control or office location. This track diagram also contains route and occupancy indication lights, positioned to represent corresponding track sections at the wayside location. To request a route, the operator actuates a first push button to select an entrance and then a second push button to select the exit. The operation of the entrance button picks up an associated stick relay whose stick circuit checks the involved track section occupancy condition and the absence of conflicting routes. The exit relays for all possible routes from the selected entrance also pick up, energized through selective circuit networks, made directional by diodes and each including checks of the non-occupancy of the involved track sections and the absence of the establishment of the directly opposing route. Operation of the exit button energizes the associated stick relay. Pick up of this relay commpletes a direct stick circuit for the corresponding exit relay and a stick circuit for itself similar to the pick up circuit for the exit relay. The exit push button stick relay pick up also releases the route relays for all conflicting routes to inhibit the establishing of any such route. This action then releases all nonselected exit relays. This completes the establishment of the selected route which may be cancelled if desired by pulling the entrance button.

With entrance and exit push button stick relays now picked up, the control functions are transmitted by a data communication system to the field or wayside location to establish the actual route through the interlocking. The traffic direction transmitted is set by the energized exit relay. At the time of transmission, all occupancy and route conflict checks have previously been made at the office. The reception of this control function data transmission at the field station energizes the selected field route relay to establish the requested track route and a movement relay to determine direction of travel, this latter responding only if the route relay including the corresponding entrance also has responded. The field route relay completes the necessary circuits to properly position the track switches to set up the requested route. The movement relay completes a selected circuit path in a field route alignment and check circuit network to energize the movement indicator at the route entrance. Completion of this network circuit checks all field route relays for conflicting routes non-actuated, the unoccupied condition of the track sections along the route, and the proper positioning of all switches. The energized movement indicator lights a movement direction signal lamp. This is a non-vital signal device used in terminal areas which, when lighted, authorizes a train to traverse the established route through the interlocking. The movement signal, when actuated, assures that the switches are positioned and locked and that the track within the interlocking is unoccupied. If a main line interlocking is controlled, the movement indicator or director signal must be a vital device and its control circuits must check not only the switches and track within the interlocking but also the advance traffic conditions and must include other safety checks. The pick up of the selected field route relay and the corresponding movement indicator relay are indicated to the office over the return communication system. Track occupancy indications within the interlocking are also transmitted but no switch position indications as they are not needed by the office control arrangement.

When alternate or run around routes are available, for example, through a pair of opposite crossovers, each such alternate may be selected by the operation of a special and extra alternate route push button. This is then followed by the operation of the entrance and exit buttons for the regular route between the two points. These actions cause the establishment of a route using the by-pass track layout. The usual checks are incorporated into the circuit network regarding conflicting routes, track occupancy, etc. The push button and exit stick relays hold in the usual manner. The alternate route push button stick relay holds over the circuits used to transmit the route controls to the field. The field registry of the special route command causes the by-pass track switches to position to set up the alternate route. The movement indicator display, however, is the same as through the regular track route was established.

As a train traverses an established route, the route locking remains in effect, through the stick circuit of the entrance push button stick relay, until the last track section of the route, i.e., the leaving end section, is occupied. The registry of the corresponding track circuit occupancy at the office interrupts this stick circuit and the entrance push button relay releases to unlock routes which conflict with portions of the established route. This sectional release thus allows other routes to be selected while the initial train is still traversing the leaving end section.

If improper control machine manipulations occur, the circuit arrangement cancels the information storages before undesired routes can be established. For example, if two entrances at one end are selected in sequence and then a common exit button is actuated, the storage by the entrance stick relays is cancelled by release of the conflicting route relays when the exit stick relay picks up. Thus the entrance information storage is cancelled by secondary means, i.e., contacts of the conflicting route relays. The exit information storage is then cancelled by primary means, the corresponding entrance stick relays. If two exit buttons are inadvertently actuated simultaneously after the proper selection of a route entrance, the entrance storage is cancelled immediately by secondary means, i.e., the release of the route relays due to conflicting selections. The exit selections are then cancelled due to the release of the entrance stick relay.

BRIEF DESCRIPTION OF THE DRAWINGS

In specifically describing a preferred arrangement of a route interlocking system embodying my invention, reference will be made to the accompanying drawings in which:

FIGS. 1A, 1B, and 1C are arranged to complete the illustration of that portion of the office control arrangement.

Figures 1A, 5:
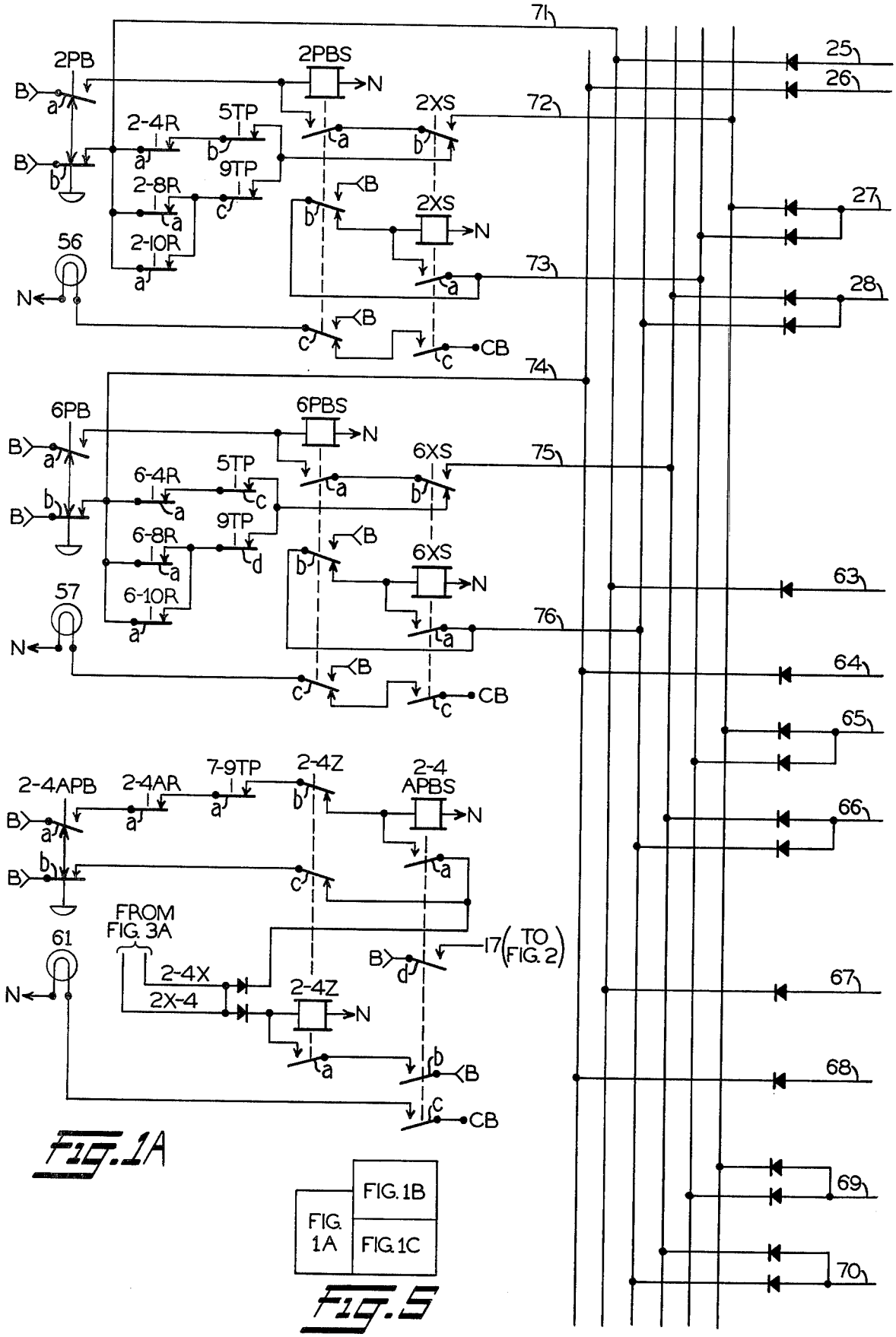
FIGS. 1A, 1B, and 1C, when arranged as shown in FIG. 5, illustrate a portion of the control office apparatus and circuits by which control of a route interlocking is accomplished.
FIG. 5 is a chart showing how

In each of the drawing figures, similar reference characters refer to similar parts of the apparatus. This is particularly true of the illustrations of the various relays and their associated controlled contacts. Wherever conveniently possible, contacts controlled by a particular relay are shown in vertical alignment above or below the conventional winding symbol. Each such contact is designated by a lower case letter reference, different from any other contact of that relay. However, to avoid unduly complicating the circuit diagrams, some contacts of certain relays are shown elsewhere, i.e., other than aligned with the winding symnbol. Such contacts are designated by the reference character for the controlling relay and by a distinguishing lower case letter. Regardless of where a relay contact is shown, the movable armature element moves up (is picked up) to close with its front contact when the relay winding is energized. When the relay is deenergized, each armature releases (moves down) to close its associated back contact. At each location, i.e., control office and field, a source of direct current energy is provided to supply operating energy to relays, lights, and other elements. This D.C. source is not shown since various types are conventionally used, and only connections to its positive and negative terminals are designated by the references B and N, respectively. A connection to a pulsed energy source, obtained from terminal B, is designated by the reference CB. The indication lamps may, if desired, be energized from a low voltage alternating current source but, for simplicity, this alternative is not illustrated.

DESCRIPTION OF THE ILLUSTRATED EMBODIMENT

Figure 3B:
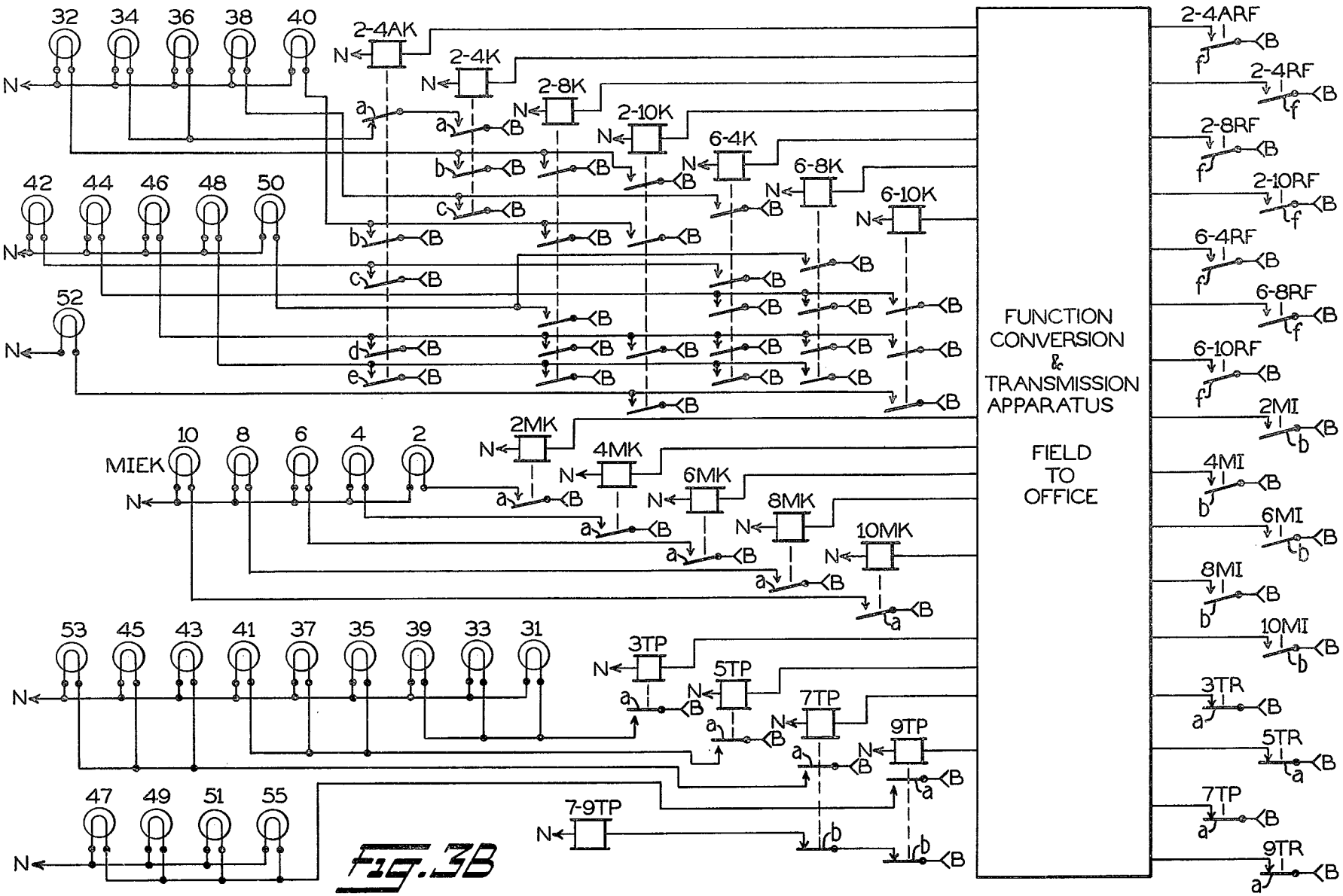
FIG. 3B illustrates the remaining portion of the data communication system by which indication functions are transmitted from the field location and registered and displayed at the office.
Figure 4:
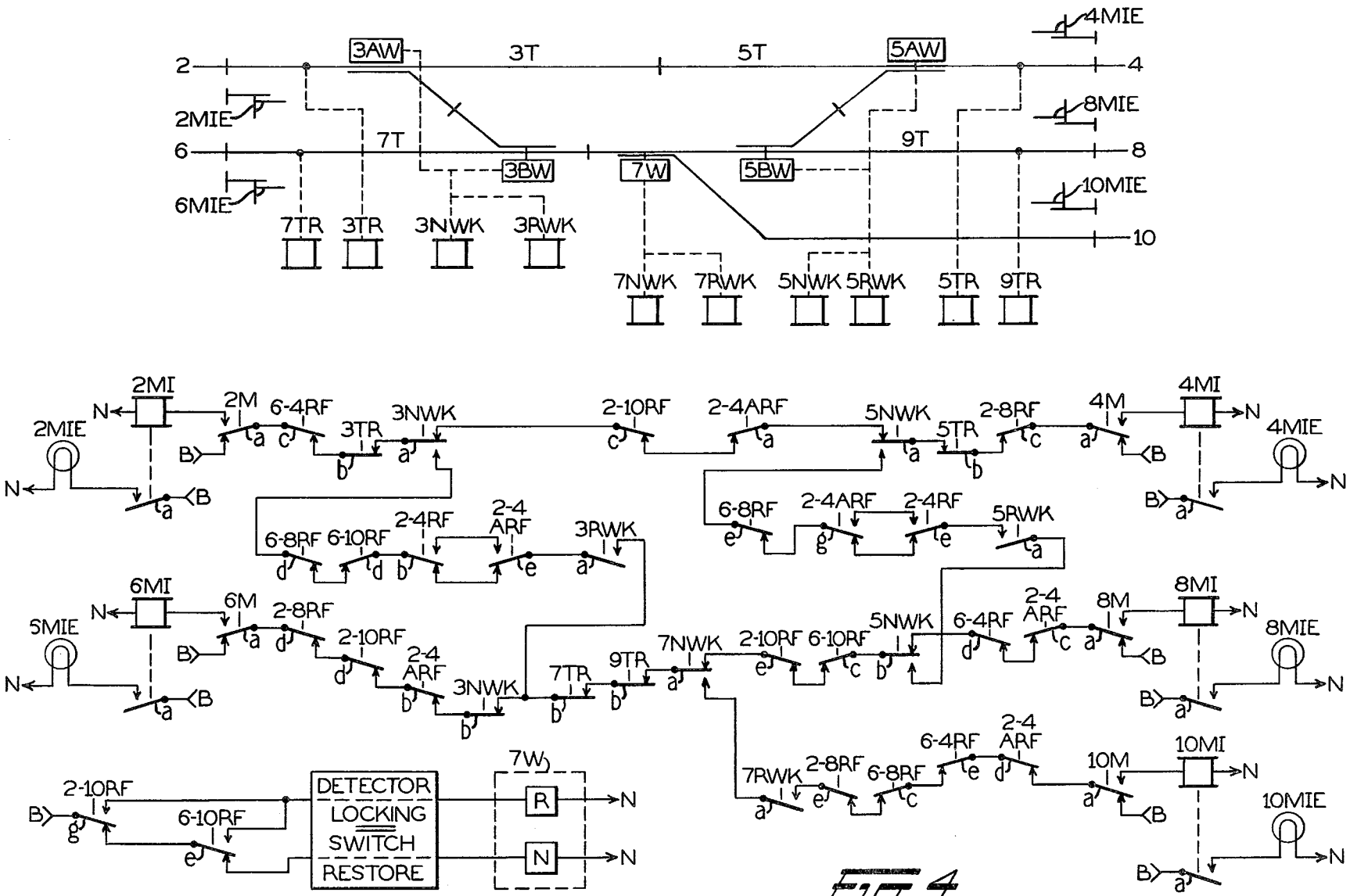
FIG. 4 illustrates, in a schematic circuit diagram form, the field station apparatus which cooperates and is controlled by the office apparatus shown in FIGS. 1 and 2.

I shall first discuss the track diagram shown at the top of FIG. 4. This is a conventional single line drawing of the track layout of a railroad interlocking assumed to be located within a terminal area. There are two main tracks, connected by a crossover in each direction, and a branch track diverging from the one main track between the crossovers. The reference numerals 2, 4, 6, 8, and 10 designate the entrances and exits, depending upon direction, into and out of the interlocking. The interlocking limits are defined by insulated joints conventionally shown at each of these numbered locations. Other insulated joints divide the track within the interlocking into track sections, 3T and 5T in the upper main track and 7T and 9T in the lower main track, the last section including also all of the branch track. Each track section is provided with a track circuit to detect train occupancy for indication to the office and for vital switch detector locking. Since any of several conventional type track circuits may be used, the details are not shown and only the track relay is illustrated, connected by a dotted line to the associated section. Track relays 3TR, 5TR, 7TR, and 9TR are normally energized and picked up when the associated track section is unoccupied and release to register the detection of a train occupying that section. These track occupancy indications are transmitted to the control office, for display on a console, as schematically shown at the bottom of FIG. 3B. The communication system shown by a block will be discussed later. It is here sufficient to understand that the closed or open condition of front contact *a* of each relay TR is directly repeated at the office by the energized or deenergized condition, respectively, of the correspondingly numbered track repeater relay TP. For example, front contact *a* of relay 3TR controls relay 3TP. An additional repeater relay 7-9TP is directly controlled by front contacts *b*, in series, of relays 7TP and 9TP, for purposes which will become evident later.

The track switches are operated by any type of known power switch machine, which are therefore shown by conventional blocks. For example, the switches of the left-hand crossover are operated in unison by switch machines 3AW and 3BW. The operation or position of each pair of crossover switches and the single switch for the branch track is registered by a pair of switch indication relays NWK and RWK. By way of example, relay 7NWK repeats the normal positioning of switch 7W when this normal position is required by the route control system. Conversely, relay 7RWK repeats the reverse positioning of switch 7W to align a route to or from the branch track. These switch indications are used in the field route alignment and check circuit network at the bottom of FIG. 4, to be discussed later, but are not transmitted to the control office.

At each entrance to the interlocking is located a movement indicator shown by the conventional symbol for a two position controlled signal and designated by the reference MIE prefixed by the entrance number. In the terminal interlocking such as assumed, these devices may be non-vital signal lamps which are lighted to authorize movement into the selected route and remain dark to prohibit a train from entering the interlocking. In otherwords, a lighted indicator is displaying a proceed indication, a dark one designates a stop indication.

A track diagram corresponding to the physical wayside or field track layout is provided on a panel of the office control machine or console. This diagram for the present disclosure appears at the top of FIG. 1B. Each eliptical symbol represents a portion of the interlocking track, normally not corresponding exactly to a track section. While each may be translucent with indication lamps behind the panel, here they are assumed to be marked on the panel with recessed indication lamps represented by the enclosed circles. The even-numbered (32 to 52) open circles represent route indications and are normally white lamps. The circles with crosses, odd numbers from 31 to 55, represent track occupancy indications which display a red light when the corresponding track portion is occupied. Circuits for lighting these route and track lamps are shown in FIG. 3B and will be described later.

The push button devices for selecting route entrance and exit ends are illustrated by the concentric circle symbols designated PB with a prefix corresponding to the location number, i.e., 2PB. These are push-pull switch devices shown elsewhere in detail. For example, push button device 4PB, shown by conventional symbol at the lower right of FIG. 1B, is illustrated as having a normally open contact *a* closed only when the device is pushed and a normally closed contact *b* opened only when the device is pulled. When a device PB is actuated, it is illuminated by an internal lamp designated by the inner circle on the console diagram. By way of example, device 4PB has a lamp 58 which is further shown by a conventional symbol below the contacts illustrated at the lower right. An auxiliary push button device 2-4APB, shown in the center of the console diagram with a lamp 61, is used to select the alternate or run-around route between locations 2 and 4, as will be explained. The condition of the field movement indicators is repeated on the control console by the several indication lamps MIEK, which are positioned to correspond to the field indicators and which may display a distinctive color when illuminated. The control circuits appear on FIG. 3B but, briefly, an indication is displayed by a lamp MIEK when the corresponding field indicator displays a proceed indication.

Figure 1B:
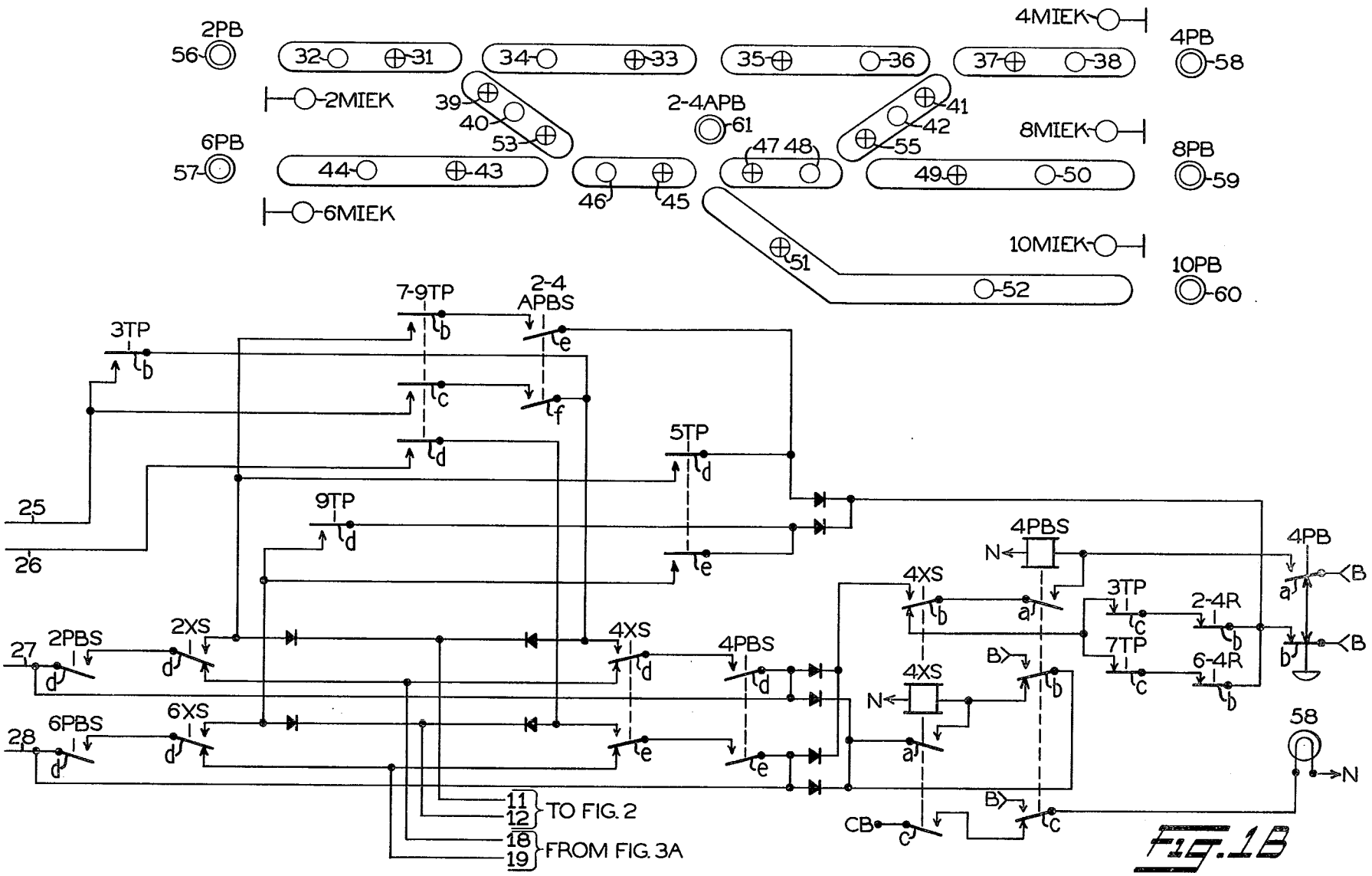
Figure 1C:
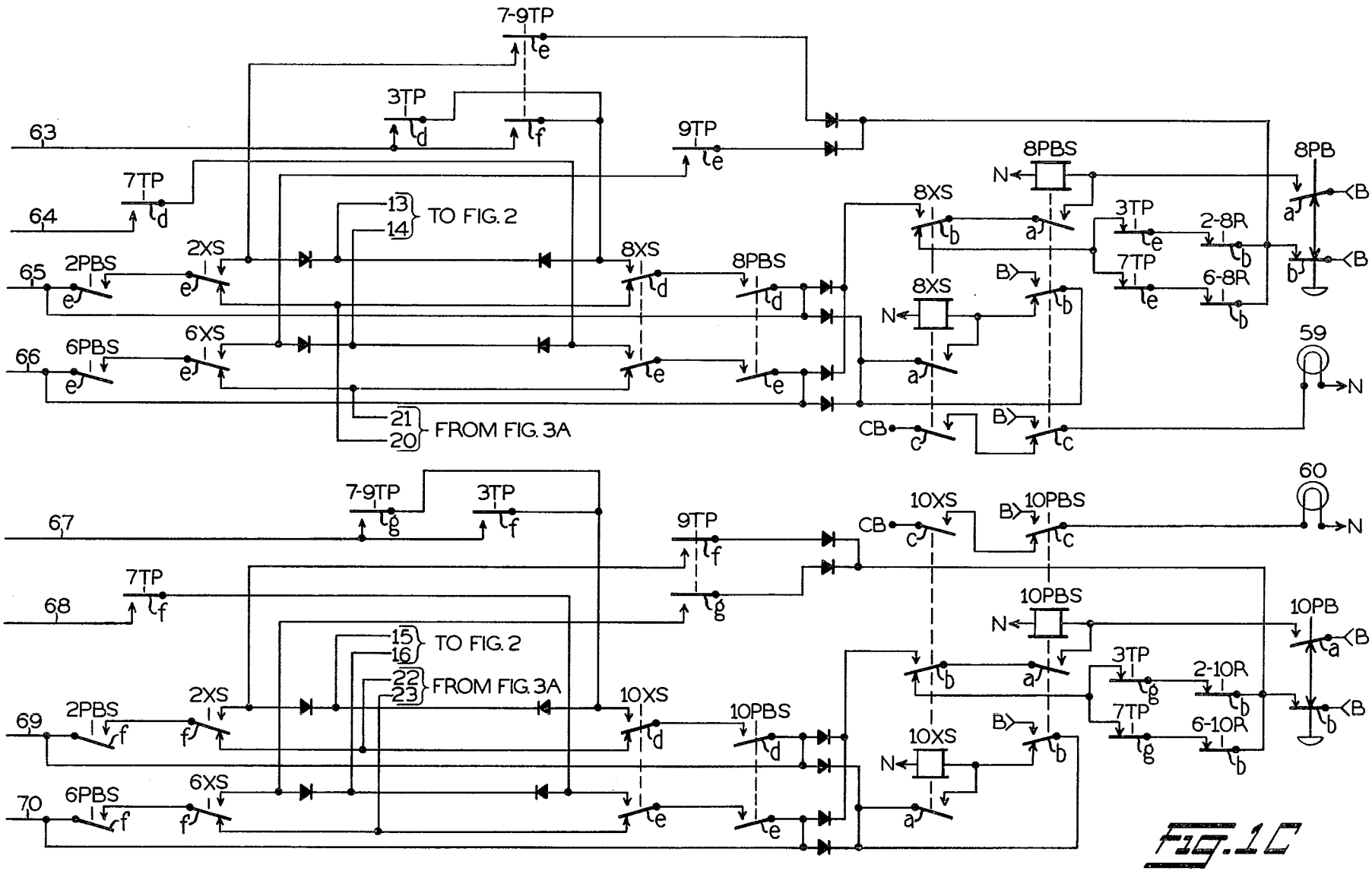
Figure 2:
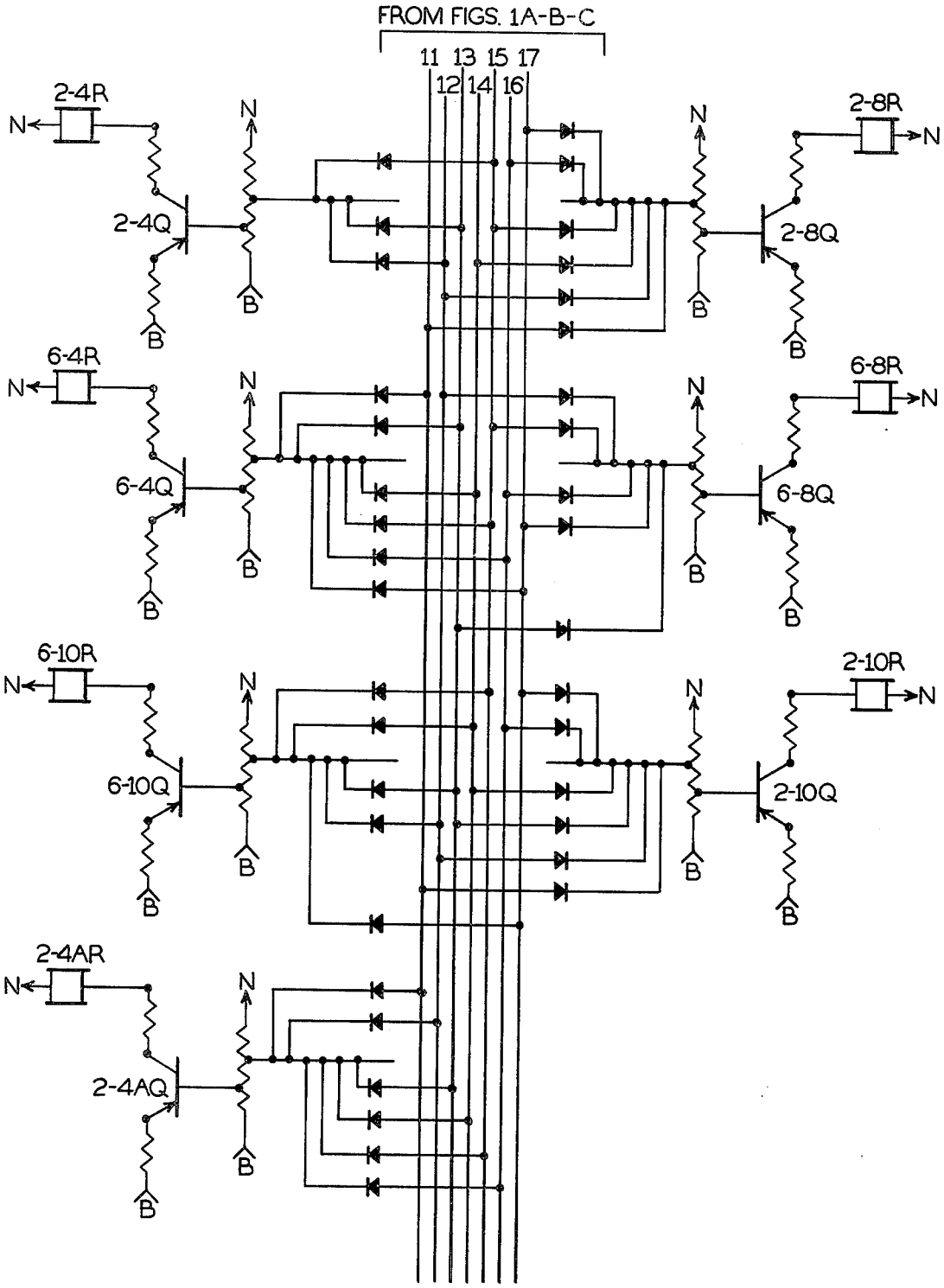
FIG. 2 shows another portion of the control apparatus of the route interlocking system embodying my invention.

I shall now refer to FIGS. 1A, 1B, and 1C, assembled as shown by the chart in FIG. 5 and with correspondingly numbered interconnecting lead wires matched. Each push button device PB has an associated stick relay PBS and exit relay XS, except device 2-4APB with which is associated stick relay 2-4APBS and a relay 2-4Z. It is to be noted that it is conventional, if required by circuit operational parameters, to snub relay windings to slightly retard release or to provide relays with slow pick up characteristics and the use of such arrangements as necessary is assumed. The route relays R and their direct, transistorized control circuits are shown in FIG. 2. There is an R relay for each possible track route through the inerlocking, regardless of train direction over the route. To the total of six route relays for the specific track layout of FIG. 1B, there is added a route relay 2-4AR for the alternate or bypass route. Referring to FIG. 2, the circuits are so arranged that the PNP transistor controlling each R relay, e.g., transistor 2-4Q for relay 2-4R, is biased to be normally "on" or conducting so that the associated relay is energized. The turnoff bias signals are then selectively supplied over leads 11 to 17 from FIG. 1 to deenergize the selected R relays, in a manner to be shortly explained. The route information is translated and transmitted to the wayside by the circuits shown in FIG. 3A. These route control circuits are also connected back into the entrance-exit selection circuitry by leads 18 or 23 which connect between FIG. 3 and FIGS. 1B and 1C.

It is now assumed that a route is to be aligned from location 2 to location 8 of the interlocking. All portions of the interlocking are assumed to be unoccupied and no routes are established so that all relays and devices are in the conditions shown. Push button 2PB is therefore actuated by the operator on his control console (FIG. 1B). The closing of contact *a* of device 2PB (FIG. 1A) energizes relay 2PBS which picks up to complete a principal stick circuit (for this operation) including its own front contact *a*, back contact *b* of relay 2XS, front contact *c* of relay 9TP, front contact *a* of relay 2-8R, and contact *b* of device 2PB. This last contact interrupts the stick circuit if the operator decides to cancel his selection and pulls device 2PB. It is to be noted that front contact *a* of relay 2-10R parallels contact *a* of relay 2-8R and that a second multiple path exists through front contact *a* of relay 2-4R and front contact *b* of relay 5TP. These multiple paths become the principal stick circuit under other route selection operations, e.g., a 2 to 4 route.

Figure 3A:
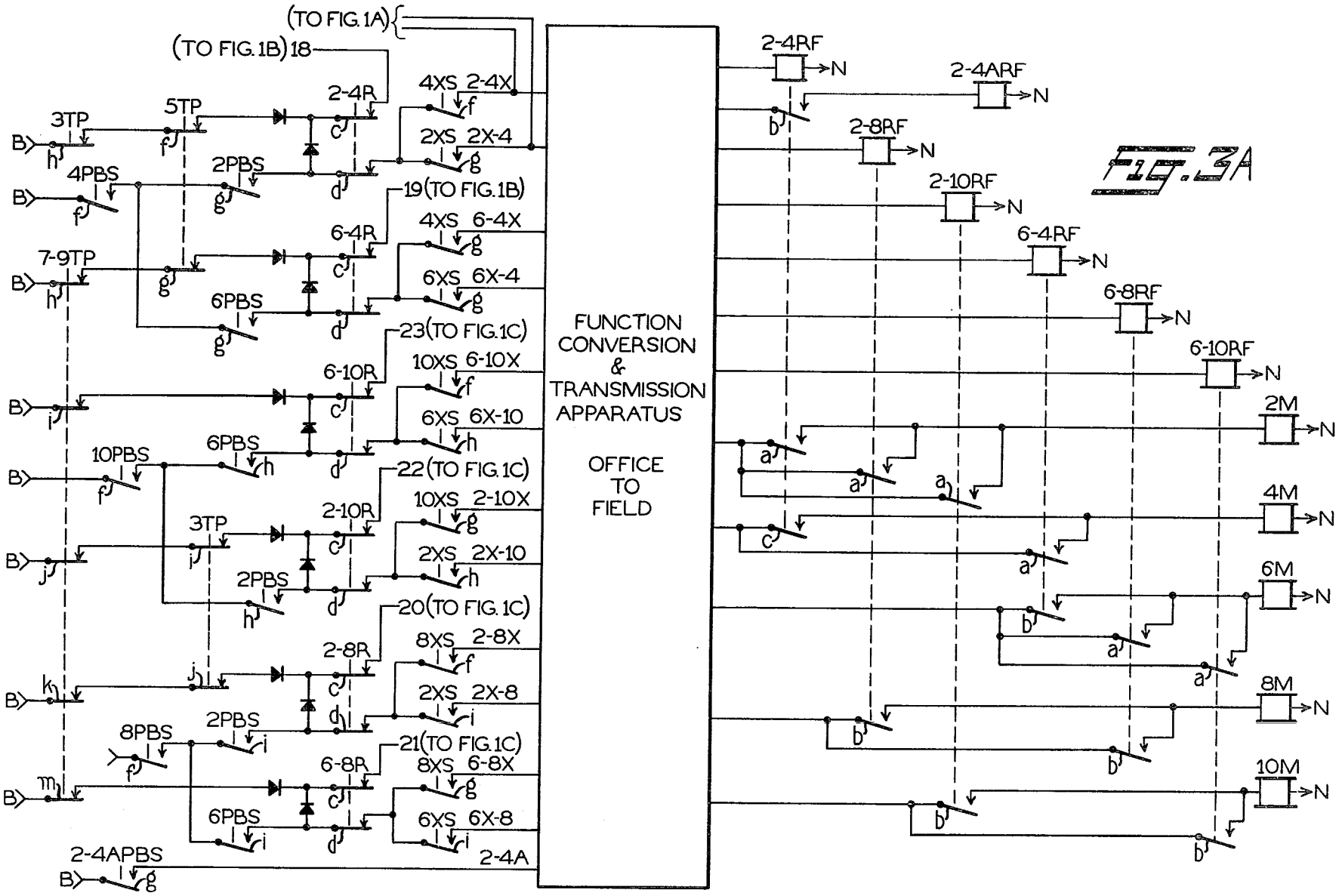
FIG. 3A shows the portion of the data communication link between the control office and wayside field station and the associated circuits by which control functions are transmitted to the wayside apparatus.

On FIG. 3A, energy from terminal B is applied to lead 20 over front contact *k* of relay 7-9TP, front contact *j* of relay 3TP, a diode, and front contact *c* of relay 2-8R. This circuit checks (TP contacts) the route unoccupied and prevents any switch control storage. Following lead 20 to FIG. 1C, energy flows over back contact *e* of relay 2XS, front contact *e* of relay 2PBS, thence to the right through a diode and over back contact *b* of relay 8PBS and the winding of relay 8XS to terminal N. Relay 8XS is thus energized and picks up, completing a stick circuit at its front contact *a* bypassing back contact *b* of relay 8PBS. Similar circuits incuding leads 18 and 22, and obvious by comparison, energize relays 4XS and 10XS, so that the exit stick relays representing each possible exit from entrance 2 are picked up. With front contact *c* of relay 2PBS closed, lamp 56 is energized to indicate on the console the selected entrance point. Also, lamps 58, 59, and 60, in devices 4PB, 8PB, and 10PB respectively, are connected to the pulsed energy source terminal CB over back contact *c* and front contact *c* of the associated PBS and XS relays, respectively, to indicate the possible exit points by flashing lights.

To complete the route selection, push button 8PB is now depressed. This energizes relay 8PBS which picks up and completes a stick circuit at its front contact *a*. This stick circuit further includes *b* of relay 8XS and the upper diode of the pair whose anodes are connected to front contact *e* of relay 2PBS, so that holding energy is received over lead 20 as previously traced for relay 8XS. A second stick circuit for relay 8XS is also completed over front contact *b* of relay 8PBS. It is to be noted that energy from terminal B is now also applied to wire 20 (FIG. 3A) over front contact *f* of relay 8PBS, front contact *i* of relay 2PBS, and the second diode whose cathode is connected to front contact *c* of relay 2-8R. This holds energy on the lead when track sections 3T, 7T, and 9T are occupied.

Energy from wire 20 is now supplied to wire 13 (FIG. 1C) over back contact *e* of relay 2XS, front contact *e* of relay 2PBS, front contact *d* of relay 8PBS, front contact *d* of relay 8XS, and a diode. On FIG. 2, this positive energy on wire 13 is applied to a second tap on the biasing potentiometer for each transistor except that for transistor 2-8Q. This switches off (non-conducting) all these transistors so that relays 2-4R, 2-10R, 6-4R, 6-8R, 6-10R, and 2-4AR release. These relays represent all routes conflicting with the selected route 2 to 8 and their release places primary locking into effect to lock out the corresponding track routes. Specifically, this primary means of inhibiting any selection of these locked out routes is effective because energy is removed, by the opening of front contacts *c* of these relays on FIG. 3A, from leads 18, 19, 21, 22, and 23. The removal of energy from leads 18 and 22 deenergizes relays 4XS and 10XS, representing the alternate possible exits, and these relays release. Lamps 58 and 60 are now extinguished and, with front contact *c* of relay 8PBS now closed, lamp 59 in device 8PB is steadily lighted.

Energy from terminal B is now applied to wire 2-8X (FIG. 3A) over front contact *f* of relay 8PBS, front contact *i* of relay 2PBS, front contact *d* of relay 2-8R, and front contact *f* of relay 8XS. This wire lead determines that the direction in this established route is from 2 to 8. If the train was to move in the opposite direction, front contact *i* of relay 2XS would be closed and lead 2X-8 energized over the remainder of the traced circuit. This energy is applied to a predetermined input of a data transmission system connecting the office and field locations. Any suitable state-of-the-art communication system which will transmit the control functions received in the form of an applied energy input, to the field to be registered as one or more selected energy output signals may be used. Details are not shown and only a conventional block represents the system. A similar block in FIG. 3B represents the portion of the simplex or duplex communication system which transmits the indication functions from the field location to the office.

Transmission of the signal on wire 2-8X causes field route relay 2-8RF at the field to be energized and pick up to register and request to establish track route 2-8. When front contact *a* of relay 2-8RF closes, directional relay 2M is also energized as result of this route control function transmission and picks up to register point 2 as the entrance to the selected route.

The switches for the No. 3 crossover now reverse to align the physical track route. A typical switch control circuit is shown in the lower left of FIG. 4 for switch 7. The operational concept is to position the switch reverse only when required for a route established from the office. At all other times, a switch is returned and held in its normal position. Specifically, for switch 7, when a route between points 2 and 10 is established by the pick up of field route relay 2-10RF, the closing of its front contact *g* completes a circuit, further including conventional detector (track) locking and restoring circuitry, for energizing the reverse magnet R of switch machine 7W. If no switch locking is in effect, the switch machine positions the switch points to their reverse position. If the registered route control is for the route between points 6 and 10, the circuit for the 7W reverse magnet is completed by front contact *e* of relay 6-10RF. As soon as relay 2-10RF or 6-10RF releases as the route is cancelled or cleared, and the switch locking is released, the circuit including back contacts *g* and *e*, respectively, of these relays is closed to energize the normal magnet N of switch machine 7W. This positions and holds switch 7 normal. In the assumed example, the pick up of relay 2-8RS, if no locking is in effect, completes a circuit for energizing the reverse magnets of switch machines 3AW and 3BW. As soon as these switches are positioned reverse, in response to the route control, indication relay 3RWK picks up, the associated relay 2NWK having released. The position of all switches involved in a route is checked in the field route alignment and check circuit network, shown at the bottom of FIG. 4.

With the route request 2-8X registered and the switches positioned, a circuit path is completed to energize movement indicator rellay 2MI (FIG.4). This circuit is traced from terminal B at back contact *a* of relay 8M over back contact *c* of relay 2-4ARF, back contact *d* of relay 6-4RF, front contact *b* of relay 5NWK, back contact *c* of relay 6-10RF, back contact *e* of relay 2-10RF, front contact *a* of relay 7NWK, front contacts *b* of relays 9TR and 7TR, front contact *a* of relay 3RWK (front contact *b* of relay 3NWK being open), back contact *e* of relay 2-4ARF, back contact *b* of relay 2-4RF, back contacts *d* of relays 6-10RF and 6-8RF, back contact *a* of relay 3NWK, front contact *b* of relay 3TR, back contact *c* of relay 6-4RF, front contact *a* of relay 2M, and the winding of relay 2MI to terminal N. This circuit checks that no conflicting route exists or is registered (all other RF relays released), that the route is properly aligned (WK relays), and that the involved track sections are unoccupied (3, 7, 9, TR picked up). Front contact *a* of relay 2M assures that a route using indicator 2MIE is selected by the multiple circuit (FIG. 3A) over front contacts *a* of relays 2-4RF, 2-8RF, and 2-10RF, the remainder of the circuit path assuring that only one of these is picked up. With relay 2MI picked up and its front contact *a* thus closed, the wayside movement indicator 2MIE is energized to display an indication authorizing a train to traverse the established route. This is a non-vital indication, assuring only that the interlocking route is aligned and unoccupied and requiring the train to move under yard or terminal operating rules.

An indication of the registry of the route request at the field is transmitted to the office. Referring to FIG. 3B, the closing of front contact *f* of relay 2-8RS transmits an indication which energizes relay 2-8K at the office. Similarly, with relay 2MI picked up, its front contact *b* transmits an indication function which energizes relay 2MK. When relay 2-8K picks up, its five front contacts close to complete obvious circuits to illuminate route lamps 32, 40, 46, 48, and 50. It is apparent on FIG. 1B that these lamps, when illuminated, mark the established route from entrance 2 to exit 8. Front contact *a* of relay 2MK provides energy to illuminate lamp 2MIEK which produces a display to indicate on the console that the field indicator is conditioned to authorize a train movement through the interlocking from point 2 to point 8. This incidently indicates that all conditions in the field were proper for establishing the requested route.

When the train accepts the signal displayed on indicator 2MIE and moves into the interlocking route, specifically section 3T, the indicator is darkened by the release of relay 2MI due to the opening of front contact *b* of relay 3TR. Indications are also transmitted to the office and relays 2MK and 3TP release. Lamp 2MIEK is extinguished to correspond with the dark wayside signal 2MIE. The closing of back contact *a* of relay 3TP energizes lamps 31, 33, and 39 which illuminate on the console to indicate occupancy of section 3T. Although not so shown here, it can be arranged if desired that the route lamps 32 and 40 are extinguished at this time to avoid having both route established and route occupied indications simultaneously displayed. As the train continues through the crossover 3 and occupies section 7T, relay 7TR releases, interrupting the circuit for relay 2MI at a second point so that this relay cannot be reenergized if the rear of a short train quickly clears section 3T. Relay 7TR also transmits an indication which releases relay 7TP. This latter relay closes its back contact *a* to energize track occupancy lamps 43, 45, and 53. If desired, the circuit path to lamp 43 can be modified to be closed only when a train is entering or exiting at point 6. It may be noted that relay 7-9TP also releases at this time. When the train enters section 9T, relay 9TR releases to further interrupt the circuit for relay 2MI and to transmit an indication which releases relay 9TP. Back contact *a* of relay 9TP closes to energize track occupancy lamps 47, 49, 51, and 55. Again, it can be arranged that lamps 51 and 55 are not energized under the existing route conditions.

Referring now to FIG. 1C, energy from terminal B is, as previously explained, present at front contact *d* of relay 8XS. When relay 3TP releases, this energy is passed over back contact *d* of this relay, lead 63, a diode, and bus 71 to front contact *a* of relay 2-8R to supply supplemental stick circuit energy to relay 2PBS. Subsequently, back contact *f* of relay 7-9TP parallels contact *d* of relay 3TP. While this supplemental stick circuit is closed, any inadvertent pulling of device 2PB in a attempt to cancel that route is inhibited since contact *b* of push button 2PB is bypassed. When the train occupies section 9T and relay 9TP releases, its front contact *c* interrupts this stick circuit and relay 2PBS releases, since front contact *a* of relay 2-4R is presently open. The opening of front contact *e* of relay 2PBS (FIG. 1C) interrupts the supply of energy from lead 20 to leads 13 and 63, and to the stick circuit of relay 8PBS. This latter relay releases and its front contact *b* interrupts the second (and final) stick circuit for relay 8XS which shortly releases. It is also to be noted that the opening of front contact *i* of relay 2PBS (FIG. 3A) removes energy from lead 20, since at least front contact *k* of relay 7-9TP is open at this time.

The removal of positive energy from lead 13 eliminates the negative bias on the transistors (2-8Q excepted) and each becomes conducting, energizing the associated R relays. Thus when the final section of the established route 2-8 is occupied, the lock on the route is cancelled. In other words, route 2-8 is sectionally released when its final track section in the direction of movement is occupied. Any conflicting route, initially locked out, which is now unoccupied may be selected and established. Specifically, in this assumed situation, if or when the rear of this train has cleared section 3T, the route between points 2 and 4 may be set up. Thus the route-lock is removed by primary means (R relays reenergized) while secondary means for circuit locking and information storage removal, comprising the TP and R relay contacts in the PBS relay stick circuitry, is also restored to normal.

If, for any reason, the operator desires to route a train from point 2 to point 4 but over both crossovers reversed, he first actuates the alternate route push button 2-4APB, located between the crossover symbols on the console. The closing contact *a* of device 2-4APB (FIG. 1A) completes a circuit including front contact *a* of relay 2-4AR to check that the alternate route is not locked out, front contact *a* of relay 7-9TP to check that the track of the alternate portion is not occupied, and back contact *b* of an auxiliary storage relay 2-4Z, which repeats energy on control function wires 2-4X and 2X-4 from FIG. 3A, to energize relay 2-4APBS. This relay picks up, completing a first stick circuit over contact *b* of device 2-4APB and back contact *c* of relay 2-4Z. Front contact *c* of relay 2-4APBS energizes lamp 61 to illuminate the associated push button. Front contact *d* of relay 2-4APBS places primary inhibiting energy on wire 17 to lock out, by primary means, all conflicting routes by biasing all transistors on FIG. 2, except transistors 2-4Q and 2-4AQ, to an off condition to thus release route relays 2-8R, 2-10R, 6-4R, 6-8R, and 6-10R.

The operator then requests route 2-4 by pushing devices 2PB and 4PB in sequence. Relay 2PBS picks up but now sticks over front contact *a* of relay 2-4R and front contact *b* of relay 5TP. Lamp 56 is illuminated. However, only relay 4XS picks up, to represent possible exits, from energy on lead 18 (see FIG. 3A) over back contact *d* of relay 2XS, front contact *d* of relay 2PBS, and back contact *b* of relay 4PBS. Relays 8XS and 10XS are not energized, as before, since energy has been removed from leads 20 and 22 by the release of relays 2-8R and 2-10R, respectively (FIG. 3A). When device 4PB is depressed, relay 4PBS picks up and sticks by energy from lead 18 over contacts *d* of relays 2XS and 2PBS, as described, and front contact *b* of relay 4XS. Relay 4XS is now held by energy over front contact *b* of relay 4PBS. Lamp 58, flashing after relay 4XS picked up, now displays a steady indication. When front contact *d* of relay 4PBS closes, energy is applied to lead 11 which biases transistor 2-4AQ to its non-conducting condition. However, release of relay 2-4AR has no effect on relay 2-4APBS which is already stuck up.

Energy is now supplied to input lead 2-4X of the control function transmitting apparatus (FIG. 3A) over front contact *f* of relay 4PBS, front contact *g* of relay 2PBS, front contact *d* of relay 2-4R, and front contact *f* of relay 4XS. Energy is also applied to input lead 2-4A by front contact *g* of relay 2-4APBS. A branch path of lead 2-4X, through a diode (FIG. 1A) applies energy to storage relay 2-4Z which picks up and sticks over front contact *b* of relay 2-4APBS. The opening of back contacts *b* and *c* of relay 2-4Z interrupts the pick up and initial stick circuits for relay 2-4APBS but energy from lead 2-4X is applied through a second diode to maintain relay 2-4APBS energized.

The transmission of the control functions applied on input leads 2-4X and 2-4A at the office energizes relay 2-4RF (FIG. 3A) and, when its front contacts *a* and *b* close, relays 2M and 2-4ARF, respectively. The pick up of relay 2-4ARF completes switch control circuits to actuate switch machines 3AW, 3BW, 5AW, and 5BW to move the corresponding switches to their reverse positions. As these switches complete the movement to the reverse positions, relays 3NWK and 5NWK release and relays 3RWK and 5RWK pick up. As soon as the physical track layout for the alternate or run-around route is established, a circuit path to energize relay 2MI is completed in the field route alignment and checking network on FIG. 4. This circuit extends from terminal B at back contact *a* of relay 4M over back contact *c* of relay 2-8RF, front contact *b* of relay 5TR, back contact *a* of relay 5NWK, back contact *e* of relay 6-8RF, front contacts *g* and *e* of relays 2-4ARF and 2-4RF, respectively, front contact *a* of relay 5RWK, back contact *b* of relay 5NWK, back contacts *c* and *e* of relays 6-10RF and 2-10RF, respectively, front contact *a* of relay 7NWK, front contacts *b* of relays 9TR and 7TR, front contact *a* of relay 3RWK (front contact *b* of relay 3NWK is open), front contacts *e* and *b* of relays 2-4ARF and 2-4RF, respectively, back contacts *d* of relays 6-10RF and 6-8RF, back contact *a* of relay 3NWK, front contact *b* of relay 3TR, back contact *c* of relay 6-4RF, front contact *a* of relay 2M, and the winding of relay 2MI to terminal N. This circuit path checks the completion of the track layout, i.e., crossovers 3 and 5 positioned reverse, the non-occupancy of all track sections, the registry of the alternate route request, i.e., relays 2-4RF and 2-4ARF picked up, and the absence of any conflicting routes by the released condition of all other RF relays. Front contact *a* of relay 2MI closes to energize the movement indicator 2MIE to authorize the train movement over the established run-around route.

With relays 2-4RF, 2-4ARF, and 2MI at the field picked up, indications are transmitted to the office (FIG. 3B) to energize relays 2-4K, 2-4AK, and 2MK. Front contact *a* of this last relay energizes lamp 2MIEK to indicate that the field movement indicator is conditioned to authorize a train movement. Back contact *a* of relay 2-4AK opens to interrupt the circuit over front contact *a* of relay 2-4K which would otherwise energize route lamps 34 and 36. However, route lamps 32 and 38 are energized over front contacts *b* and *c*, respectively, of relay 2-4K. To complete an indication of the establishment of the alternate route between points 2 and 4, lamps 40, 42, 46, and 48 are energized by the closing of front contacts *b, c, d,* and *e* of relay 2-4AK.

As the train traverses this established run-around or alternate route from point 2 to point 4, it occupies in sequence sections 3T, 7T, 9T, and 5T. The corresponding track relays release in order and indications are transmitted to the office so that relays 3TP, 7TP, 9TP, and 5TP also release in order. Relay 7-9TP releases shortly after relay 7TP but remains released until relay 9TP picks up as the train clears section 9T. The TP relays, as described, cause the various track occupancy lights to illuminate to indicate the progress of the train.

As the train traverses the route, the track relay repeaters at the office hold the route locked until the final section is occupied. Energy is maintained on lead 18 (FIG. 3A), for the stick circuit of relay 4PBS, by front contacts *f* and *g* of relays 4PBS and 2PS, respectively, so that the release of relays 3TP and 5TP has no effect on relay 4PBS and the route locking. When relay 3TP releases, energy from lead 18 is also applied over front contacts *d* of relays 4PBS and 4XS, back contact *b* of relay 3TP, and leads 25 and 71 to the stick circuit of relay 2PBS at front contact *a* of relay 2-4R. This bypasses pull contact *b* of device 2PB so that the operator can no longer cancel his route selection. When relay 7TP releases, the circuit path through front contact *f* of relay 2-4APBS and back contact *c* of relay 7-9TP bypasses back contact *b* of relay 3TP in this route locking circuit. Not until the train occupies section 5T, and causes the release of relay 5TP to open its front contact *b* (FIG. 1A), is the stick circuit for relay 2PBS interrupted. The opening of front contact *g* of relay 2PBS (FIG. 3A) removes energy from lead 18 and relay 4PBS is therefore deenergized and releases. The opening of front contact *b* of relay 4PBS deenergizes relay 4XS which releases. The alternate route is now released and any other route which does not conflict with the portions remaining occupied may be selected and established. For example, in the specific example herein, when the train on the alternate route occupies only section 5T, a route from point 2 or 6 to point 10 can be set up.

The TP and R relay contacts included in the stick circuits of the PBS relays provide a secondary means for circuit lockout and information storage cancellation in the event of improper operation of the control machine. Assume that, with the interlocking unoccupied, push buttons 2PB, 6PB, and 4PB are depressed in that order. This represents an improper operation in that two entrances are selected and then a common exit.

Relay 2PBS and then relay 6PBS pick up and hold over the normal initial stick circuits. When relay 2PBS picks up, its front contacts *d, e,* and *f* (FIGS. 1B, C) complete circuits from leads 18, 20, and 22, respectively, to energize exit relays 4XS, 8XS, and 10XS in the normal manner. The pick up of relay 6PBS does not change this situation but merely completes a multiple path for each exit relay (from leads 91, 21, 23).

However, when relay 4PBS picks up, the closing of its front contacts *d* and *e* applies energy, over corresponding contacts of relay 4XS, to leads 11 and 12. This biases all transistors on FIG. 2 to their off or non-conducting condition to deenergize all R relays which release. The opening of front contacts *a* of relays 2-4R, 2-8R, and 2-10R interrupts all stick circuits for relay 2PBS while front contacts *a* of relays 6-4R, 6-8R, and 6-10R open all stick circuits of relay 6PBS. Relays 2PBS and 6PBS are thus released by secondary means to cancel the stored entrance selection information. Meanwhile, relay 4PBS is released by primary means, i.e., the opening of front contacts *c* of relays 2-4R and 6-4R (FIG. 3A) removes energy from leads 18 and 19 and thus both stick circuits for relay 4PBS and the initial stick circuits for relay 4XS. The opening of front contact *b* of relay 4PBS interrupts the remaining stick circuit for relay 4XS which then releases. The unselected exit relays 8XS and 10XS have already released. Thus all information storages have been cancelled and no routes are aligned by this improper machine operation.

If more than one push button is operated simultaneously, or very nearly so, while selecting an exit location, no route is established and all stored information is cancelled. For example, assume that location 6 is selected as the entrance by depressing push button 6PB. Relay 6PBS picks up and then holds by energy through the multiple path stick circuit network originating at contact *b* of device 6PB. Since any of locations 4, 8, and 10 are possible exits, relays 4XS, 8XS, and 10XS pick up from energy on leads 19, 21, and 23, respectively.

If, in selecting an exit, push buttons 4PB and 8PB are both inadvertently activated simultaneously, relays 4PBS and 8PBS pick up. The normal stick circuits hold these relays and each completes a final stick circuit for the associated XS relay. With front contacts *e* of relays 4PBS and 8PBS closed, energy is applied to leads 12 and 14. This biases all transistors on FIG. 2 to their non-conducting condition which releases all the R relays. Relays 4PBS and 8PBS, as well as relay 10XS, are now deenergized, by primary means, i.e., the opening of front contacts *c* of relays 6-4R, 6-8R, and 6-10R (FIG. 3A) to remove energy from leads 19, 21, and 23. Meanwhile, the opening of front contacts *a* of the same relays interrupts all paths in the stick circuit network for relay 6PBS which therefore releases, controlled by these secondary means. No route is aligned and no route information remains stored in the system. It is to be noted that if sufficient time elapses between the sequential operation of devices 4PB and 8PB, the selection of exit 4 is effective and the route 6 to 4 is aligned. However, other improper machine operation which attempts to align conflicting routes also results in the cancellation of all stored route request information and the refusal to align any route.

The apparatus arrangement of my invention thus provides an efficient system for controlling a railroad interlocking layout, especially one included in a terminal or yard where restricted operating speeds are in effect. To establish a route through the interlocking, the entrance and exit locations only are selected. This activates within the control machine a check of the existence of any conflicting routes and of the occupancy condition of the track sections. Control and indication of track switches is not provided in the control machine but is limited to the wayside only. The system is thus route oriented and switch positioning is in accordance with the route request received at the wayside location. Improper operation of the control machine results in the automatic cancellation of the route information storages and does not establish any route. Run-around or alternate routes are selected by operation of a single additional push button selector for each such route. The system embodying my invention is therefore efficient, safe, and economical.

Although I have shown and described herein but a single specific arrangement embodying the interlocking control system of my invention, it is to be understood that various modifications and changes may be made therein within the scope of the appended claims without departing from the spirit and scope of my invention.

Having now described the invention, what I claim as new and desire to secure by Letters Patents, is:

1. Remote control apparatus for routing trains through a railroad interlocking which includes a plurality of locations marking the boundary limits of the interlocking track layout at which trains enter or exit the interlocking, track circuits for detecting train occupancy of predetermined track sections within the boundary limits, and control and indication means at the track wayside for track switches which establish individual routes, comprising in combination, a. a selection means associated with each limit location and operable in pairs for sequentially selecting the entrance and exit locations of a desired track route, b. a registry means coupled to each selection means and responsive to operation of that selection means for registering the selection of that location as an entrance or exit for a desired route, c. primary means responsive to the selection of an exit location subsequent to an entrance location for locking out conflicting routes and all other possible exit locations and connected for holding a registered exit location stored, d. an exit storage means for each location coupled for checking the non-occupancy of the track sections between the selected entrance location and the corresponding location when it is a possible exit and controlled by said primary means for retaining the exit storage only when that location is selected, e. a separate selection means for each alternate route between any two locations in said interlocking layout, f. a separate registry means controlled by each alternate route selection means for registering the selection of the corresponding alternate route in lieu of the basic route, g. an auxiliary storage means associated with each alternate route selection means and controlled by said primary means and the registry means associated with each limit location of the corresponding basic route for storing the final establishment of any route, alternate or basic, between the associated limit locations, 1. each auxiliary storage means coupled for inhibiting the registration of the corresponding alternate route selection if the associated basic route is already established, and h. secondary means for each location controlled by said primary means and by said track circuits in accordance with track occupancy conditions and coupled to the corresponding registry means for holding the entrance selection registered while the route is established, 1. each secondary means responsive to occupancy of the last track section in an established route for cancelling the entrance registry storage to release the established route, i. each registry means further coupled for cascading the cancellation of a route entrance storage to release the associated exit selection registry and the corresponding exit storage, j. the pair of registry means for each limit location of each possible basic track route through said interlocking, any associated separate registry means for an alternate route, and the associated exit storage means coupled for jointly actuating said track switch control means to complete the corresponding track route when entrance and exit selections for that route or an associated alternate route are registered and stored.

2. Interlocking control apparatus as defined in claim 1 in which, a. said primary means controls said secondary means for cancelling all entrance registration information if an improper selection of route entrances and exits occurs, and b. said primary means is further responsive to an improper selection of route entrances and exits for releasing all exit storage means to cancel all stored exit information corresponding to the improper selections.

3. Interlocking control apparatus as defined in claim 2 which further includes at the wayside location, a. function receiving means coupled for receiving route control functions from the registry means and the exit storage means designating the established route, b. said function receiving means connected to said switch control means for positioning the track switches within the interlocking to align the established route, and c. a route alignment and check circuit network jointly controlled by said function receiving means, said switch indication means, and said track circuits and coupled for supplying movement signals authorizing a train to traverse an established route only when the switches are positioned and the track sections unoccupied.

4. Route oriented control apparatus for a railroad interlocking; which includes a plurality of limit locations where trains enter and exit the interlocking, a control location console from which control is exercised by an operator, track switch control apparatus at track wayside points to operate track switches to positions required to complete selected routes, and a track occupancy detection means for each of a plurality of track sections within the interlocking limits; comprising in combination, a. selector means associated with each limit location and operable for registering that location as the entrance or exit of a selected route, b. exit storage means at each location operable to store the selection of the associated location as a route exit, c. a circuit network for each exit storage means controlled by the plurality of track occupancy detection means and by the selector means for each possible entrance location for that exit for registering the associated exit storage means as a possible exit when one of the possible entrance selector means is operated, d. each circuit network further controlled by the corresponding selector means for storing an exit selection in said associated exit storage means when the corresponding location is selected as a route exit, 1. each circuit network also coupled at times by said associated exit storage means for holding the exit selection registry in the corresponding selector means while the route remains established, e. primary means controlled by the several selector means and exit storage means and coupled for locking out selection of all conflicting routes and all other possible exit locations in response to the sequential selection of a route entrance and exit locations, and f. secondary means for each location controlled by said primary means and said track occupancy detection means and coupled to the associated selector means for storing a registered route entrance selection while that route remains established, 1. each secondary means being responsive to the occupancy of the final section by a train transversing an established route for cancelling the stored entrance registry to release that route, g. each circuit network responsive to the cancellation of an associated route entrance storage for cascading the release to cancel the route exit selection and storage.

5. Interlocking control apparatus as defined in claim 4 which further includes, a. a transmission means controlled by the several selector and exit storage means and by said primary means for registering control functions at the wayside location for the route selected and established in the control console, 1. said transmission means being coupled at the wayside locations to the switch control apparatus for positioning the track switches to complete the selected route through the track layout, and b. a route alignment and check circuit network controlled by said switch control apparatus, said transmission means, and the plurality of track occupancy detection means, and coupled for actuating a movement signal to authorize a train movement through the interlocking when the selected route layout is complete and the corresponding track sections unoccupied.

6. Interlocking control apparatus as defined in claim 5 in which said transmission means comprises, a. a communication system coupled between said control location and the wayside location for transmitting control functions to the wayside and indication functions to said console, 1. said several selector and exit storage means and said primary means at the control location coupled to said communication system for supplying for transmission control functions representing the selected route and direction established in said control console, b. a plurality of registry relays at the wayside location coupled for receiving and registering the selected route and direction functions transmitted from said control location, 1. said registry relays coupled for controlling said switch apparatus and said route alignment and check circuit network to complete the track route layout required for the selected route and to jointly actuate the proper movement signal, and in which, c. said registry relays, the several movement signals, and track detection means are jointly coupled to said communication system for transmitting route and occupancy indication functions to said console to register route and track occupancy conditions at said wayside location.

7. Interlocking control apparatus as defined in claim 6 in which, a. each selector means comprises a normally open contact device operable to close its contact and a first normally deenergized relay, 1. said first relay controlled by the associated device to be energized to register the selection of the corresponding location as a route entrance or exit when said normally open contact is closed, b. each exit storage means is a second normally deenergized relay, and c. the circuit network for each exit storage relay comprises, 1. an energizing circuit network controlled by the first relays of each possible entrance location, the track detection indication means for the intervening track sections in each possible route to that exit, and said primary means for energizing that exit storage relay to register a possible exit location when one of the possible first relays is energized if a primary means lockout is not in effect and the intervening track sections are unoccupied, and 2. a stick circuit including an energized position contact of the associated first relay for holding the registered exit location stored while the selected route remains established.

and which further includes, d. a first stick circuit network for each first relay including a deenergized position contact of the associated second relay and controlled by the associated secondary means for holding an entrance selection registered while the route remains established, and e. a second stick circuit network for each first relay including an energized position contact of the associated second relay and controlled by the first relay of a selected possible entrance location for holding a route exit selection registered while that route remains established.

8. Interlocking control apparatus as defined in claim 7 in which said primary means comprises, a. a plurality of normally energized route relays, one for each track route layout through the interlocking, regardless of direction, each held normally energized by a two condition circuit means responsive to the selection of the entrance and exit locations for a conflicting route for deenergizing the associated route relay, b. each route relay coupled for interrupting when deenergized the circuit networks for the exit storage relays for the locations at each end of the corresponding track route to inhibit the selection of that route while a conflicting route remains established.

9. Interlocking control apparatus as defined in claim 8 in which each secondary means comprises a circuit network having a plurality of parallel circuit paths each including in series, a. an energized position contact of a route relay corresponding to a route entering at the same location for releasing an entry registration if conflicting routes are improperly selected substantially simultaneously, and b. a normally closed contact controlled by the train detection indication means for the last track section of a route corresponding to the associated route relay contact and entering at the same location, said contact being opened when that last section is occupied for releasing the route entry registration in the associated first relay and initiating the cascaded release of the corresponding exit registration and exit storage.

10. Interlocking control apparatus as defined in claim 8 in which, a. each two condition circuit means is a transistor normally biased to the conducting condition to hold the associated route relay energized, b. the first and second relays of each route are coupled to the biasing circuit of each transistor associated with a conflicting route for shifting that transistor to the nonconducting condition, when the relays are energized to select a corresponding route, to release the route relay associated with each conflicting route transistor to inhibit the selection of any conflicting route.

11. Interlocking control apparatus as defined in claim 6, in which the interlocking layout has at least one alternate route to the basic route between two predetermined limit locations, and in which the apparatus further includes, a. a separate selector means for said alternate route operable for registering the selection of the alternate route between said predetermined locations, and b. an auxiliary storage means associated with said alternate route selector means and controlled by the selector means and exit storage means for both limit locations of said basic route for registering the establishment of any route, basic or alternate, between said predetermined locations, 1. said auxiliary storage means further controlled by the associated alternate route selector means for storing the establishment of said alternate route until the alternate route selection registration is released.

c. said auxiliary storage means coupled for inhibiting the registry of an alternate route selection when the basic route has been previously established, d. said alternate route selector means being further coupled to said transmission means for registering an alternate route selection control function at said wayside location to control, jointly with the registered basic route functions, said switch control apparatus to complete the alternate route through the interlocking track layout.

* * * * *

UNITED STATES PATENT AND TRADEMARK OFFICE

CERTIFICATE OF CORRECTION

PATENT NO. : 4,066,228

DATED : January 3, 1978

INVENTOR(S) : J. Calvin Elder

It is certified that error appears in the above-identified patent and that said Letters Patent are hereby corrected as shown below:

Column 16, lines 32-33, change "trans-versing"

to --traversing--

Signed and Sealed this

*Twenty-ninth* Day of *August 1978*

[SEAL]

*Attest:*

RUTH C. MASON
*Attesting Officer*

DONALD W. BANNER
*Commissioner of Patents and Trademarks*